US011114266B1

(12) United States Patent
Faust

(10) Patent No.: US 11,114,266 B1
(45) Date of Patent: Sep. 7, 2021

(54) ELEMENT SUB-STRUCTURE

(71) Applicant: Littelfuse, Inc., Chicago, IL (US)

(72) Inventor: Scott Faust, Chicago, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 16/835,869

(22) Filed: Mar. 31, 2020

(51) Int. Cl.

| | |
|---|---|
| ***H01H 85/20*** | (2006.01) |
| ***H01R 4/58*** | (2006.01) |
| ***H01H 85/165*** | (2006.01) |
| ***H01H 85/143*** | (2006.01) |
| ***H01R 4/02*** | (2006.01) |

(52) U.S. Cl.
CPC ..... *H01H 85/20* (2013.01); *H01H 85/143* (2013.01); *H01H 85/165* (2013.01); *H01R 4/029* (2013.01); *H01R 4/58* (2013.01)

(58) Field of Classification Search
CPC .... H01H 69/02; H01H 85/143; H01H 85/165; H01H 85/175; H01H 85/1755; H01H 85/185; H01H 85/20; H01H 85/22; H01R 4/029; H01R 4/58
See application file for complete search history.

(56) References Cited

U.S. PATENT DOCUMENTS

| | | | | |
|---|---|---|---|---|
| 4,220,940 | A * | 9/1980 | Huber | H01H 85/185 337/231 |
| 2008/0184560 | A1* | 8/2008 | Pizzi | H01H 69/02 29/883 |
| 2009/0072943 | A1* | 3/2009 | Aberin | H01H 85/20 337/186 |
| 2010/0194519 | A1* | 8/2010 | Harris | H01H 85/38 337/227 |
| 2016/0141138 | A1* | 5/2016 | Schlaak | H01H 85/185 337/231 |
| 2016/0141140 | A1* | 5/2016 | Schmidt | H01H 85/38 337/187 |
| 2016/0268089 | A1* | 9/2016 | Schlaak | H01H 85/185 |
| 2017/0084415 | A1* | 3/2017 | Nakanishi | H01H 85/08 |
| 2019/0088436 | A1* | 3/2019 | Aberin | H01H 85/143 |
| 2020/0090893 | A1* | 3/2020 | Leung | H01H 85/50 |

* cited by examiner

*Primary Examiner* — Jacob R Crum
(74) *Attorney, Agent, or Firm* — Kacvinsky Daisak Bluni PLLC

(57) ABSTRACT

A sub-structure element support system is disclosed. The sub-structure element support system includes a novel molded structure designed to support an electrical element, such as a fuse. The molded structure is a protective and insulative sleeve for the electrical element and reduces forces on the electrical element during free-fall and operation conditions. The molded structure also facilitates automation during manufacturing and reduces cost.

18 Claims, 7 Drawing Sheets

ELEMENT SUB-STRUCTURE

BACKGROUND

Fuses are devices used in electrical systems to protect against excessive current. Fuses are sacrificial devices which break when an overcurrent condition occurs in the electrical system. The breakage causes an open circuit, thus protecting devices to which the fuse is connected. Fuses come in a variety of shapes and sizes and have many applications, from small circuit electronics to large-scale industrial applications.

Fuses include a metal portion, such as a wire or strip, that links two metal contact terminals together, and are encased in a non-combustible material. The metal portion is usually made from zinc, copper, silver, or aluminum. If too much current flows, the metal portion will melt, interrupting the circuit. Fuses are rated for the circuit protection they provide with specific current and voltage ratings, breaking capacities, and response times.

SUMMARY

In various embodiments, a molded structure and sub-structure element support system are disclosed. The molded structure is designed to support an electrical element, such as a fuse, so as to aid in manufacturing, reduce forces during free-fall, reduce cost, and increase automation possibilities.

In one embodiment, a molded structure to support an electrical element is provided. The molded structure may include a first end bell coupled to a first copper terminal, a second end bell coupled to a second copper terminal, and an aperture for receiving the electrical element such that one end of the electrical element is coupled to the first copper terminal and a second end of the electrical element is coupled to the second copper terminal.

In a second embodiment, a sub-structure element support system is provided. The sub-structure element support system may include first and second copper terminals and a molded structure. The molded structure may include a first end bell coupled to the first copper terminal, a second end bell coupled to the second copper terminal, wherein the first end bell is a predetermined length apart from the second end bell. The molded structure further may include a left bottom rib, a left top rib, and a first center portion connecting the left bottom rib to the left top rib, and a right bottom rib, a right top rib, and a second center portion coupling the right bottom rib to the right top rib. Further, the molded structure may include an enclosure for receiving the molded structure, wherein the first and second copper terminals are disposed on either side of the enclosure.

In a third embodiment, a molded structure to support an electrical element is provided. The molded structure may include an end bell coupled to a first copper terminal, wherein the first copper terminal is to be welded to one end of the electrical element, an end portion for supporting a second copper terminal, the second copper terminal to be welded to a second end of the electrical element, bottom ribs coupled between the end bell and the end portion, top ribs coupled between the end bell and the end portion, the bottom and top ribs to support either side of the electrical element, and a detached end bell to be affixed to the second copper terminal. Further, the molded structure may be made from a non-combustible material.

DETAILED DESCRIPTION

A sub-structure element support system is disclosed. The sub-structure element support system includes a novel molded structure designed to support a fuse element. In addition to being a protective and insulative sleeve to reduce forces during free-fall and operation conditions, the molded structure also facilitates automation during manufacturing and reduces cost.

Figure 1:
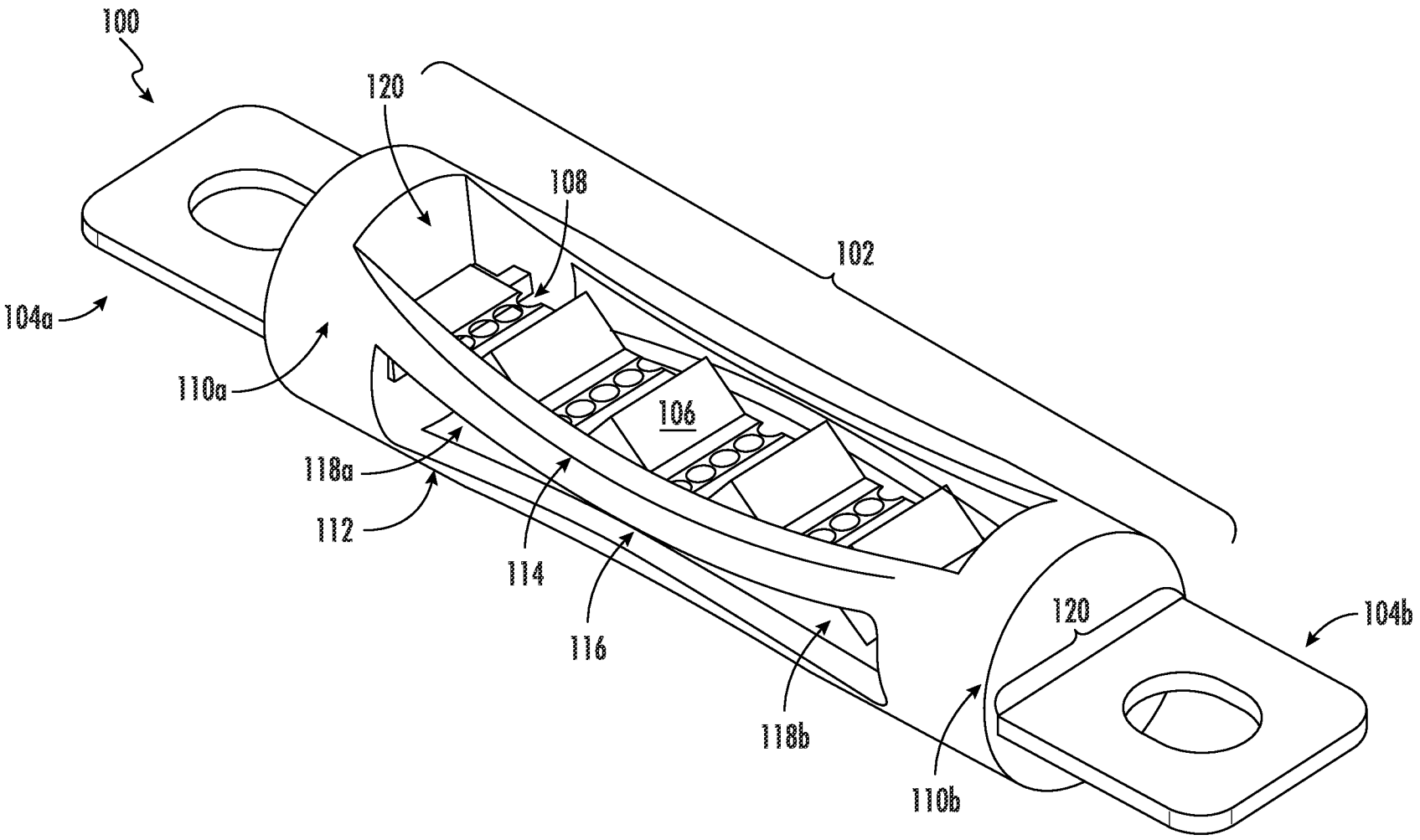
FIG. 1 is a diagram illustrating a sub-structure element support system, in accordance with exemplary embodiments.

FIG. 1 is a representative drawing of a sub-structure element support system 100, according to exemplary embodiments. The sub-structure element support system 100 consists of a molded structure 102 which operates as the sub-structure for an electrical component (element). The molded structure 102 is integrated with copper terminals 104*a* and 104*b* (collectively, "copper terminal(s) 104"). The molded structure 102 is designed to act as a support sleeve or backbone for an electronic element disposed between the copper terminals 104. In the example illustration of FIG. 1, the electronic element is shown as a fuse 106.

The fuse element 106 of the exemplary embodiment of FIG. 1 consists of individual portions with sacrificial portions 108 disposed therebetween. The sacrificial portions 108 are the part of the fuse that melt when too much current flows through the circuit. The molded structure 102 is disposed around the fuse element 106.

The molded structure 102 includes an aperture (opening) 120 at the top for receiving the fuse element 106. In an exemplary embodiment, the molded structure 102 has a second aperture at the bottom for receiving a second fuse element (not shown).

End bells 110*a* and 110*b* (collectively, "end bell(s) 110") are disposed at either end of the molded structure 102. The end bells 110 each include slots 120 for receiving and securing respective copper terminals 104 through the molded structure 102. In one embodiment, the copper terminals 104 are molded into respective end bells 110. In another embodiment, the copper terminals 104 are press-fit into respective end bells 110. Design engineers of ordinary skill in the art will recognize a number of different ways in which the copper terminals may be permanently affixed through the slots 120 of respective end bells 110. On each side of the fuse element 106, the molded structure 102 also consists of bottom and top ribs, with a bottom rib 112 and a top rib 114 showing on one side. The top ribs 512 and bottom ribs 514 are connected between the two end bell 110, thus forming a substantially cylindrical shape. In exemplary embodiments, the cylindrical shape has dimensions that closely match the inner surface dimension of an enclosure body to which the molded structure 102 will be fit.

In an exemplary embodiment, the molded structure 102 is formed with side portions that are initially solid, with triangle cutouts being made on each side to reduce the amount of material of the molded structure. Thus, bottom rib 112 and top rib 114 are formed by triangle cutouts 118*a* and 118*b*, with center portion 116 remaining to join the bottom and top ribs (collectively, "triangle cutout(s) 118"). The triangle cutouts 118, which may vary in number and shape, reduce the amount of material used to form the molded structure 102, without diminishing its support capability.

In an exemplary embodiment, the molded structure 102 is made using plastic or other non-conductive elastomeric materials to provide support to the fuse element 106. In another embodiment, the molded structure 102 is made of ceramic, which is also non-conductive. In yet another embodiment, the molded structure 102 may be made from melamine sheets. Or, the molded structure 102 may be made using a combination of non-conductive materials. During manufacture, the molded structure 102 may further be infused with materials to provide additional desirable properties, such as fire retardant material. Design engineers of ordinary skill in the art will recognize a number of materials or material combinations that may be suitable for manufacturing the molded structure.

The sub-structure element support system 100 enables the manufacture and handling of the fuse element 106 from initial manufacture until its placement into its intended electronic circuit environment. The molded structure 102 with the integrated copper terminals 104 acts as a backbone for the fuse element 106. Once manufactured, the fuse element 106 is placed in the top aperture 120 or bottom opening of the molded structure 102, such that each end of the fuse element is coupled, then welded or soldered to respective copper terminals 104. The fuse element 106 is thereafter supported by the bottom ribs 112, center portion 116, and top ribs 114 of the molded structure 102. In addition to providing support, the molded structure 102 operates as a mechanism for fixturing the fuse element 106 during its movement from manufacture to final placement.

Figure 2:
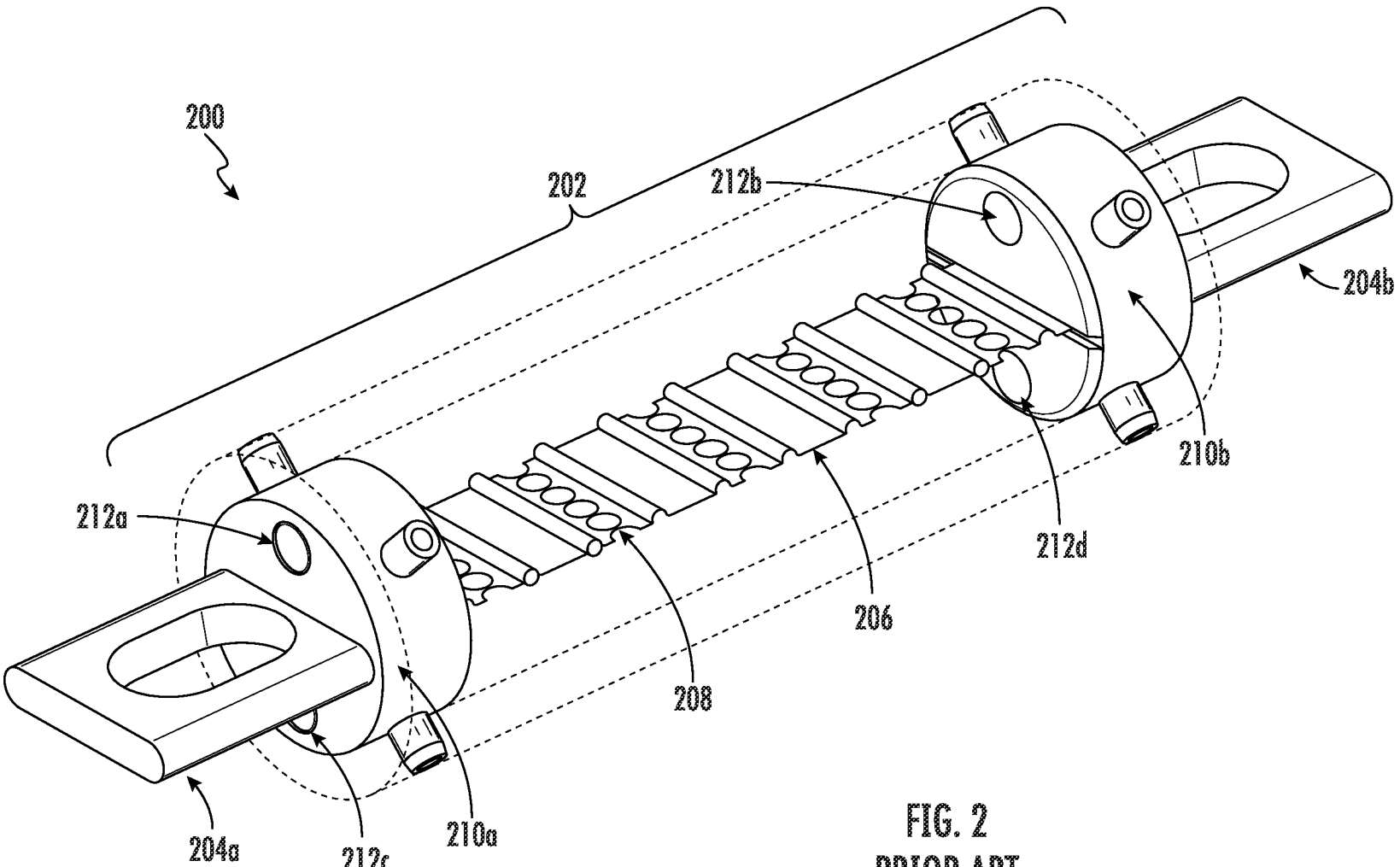
FIG. 2 PRIOR ART
FIG. 2 is a diagram illustrating fuse assembly, in accordance with the prior art.

FIG. 2 illustrates a fuse assembly 200 according to the prior art. The fuse assembly 200 includes an enclosure body 202, copper terminals 204*a* and 204*b* (collectively, "copper terminal(s) 204"), the fuse element 206 with sacrificial portions 208, and end bells 210*a* and 210*b* (collectively, "end bell(s) 210"). The end bells 210 are typically made from brass and are thick and heavy, and thus expensive, as compared to the plastic or ceramic material used to make the molded structure 102 of FIG. 1.

The traditional fuse assembly 200 must be supported during attachment of the fuse element 206 until the enclosure body 202 can be attached, as there is no support skeleton such as the molded structure 102. The end bells 210 would have to be bolted down to a separate fixture at the appropriate distance apart, then the fuse element 206 would be attached to respective copper terminals 204 connected to the end bells. The enclosure body 202 would be slid over the structure before the assembly is removed from the separate fixture.

For example, temporary compression pins (not shown) may be pressed through the openings 212*a-d* to attach to the separate fixture. Alternatively, the end bells may be otherwise hard fixtured to a surface. In both cases, the process is time consuming and has potential to damage the fuse during assembly. Further, no support is provided for the fuse element 206 until the final stage of assembly. Another drawback is that multiple manual operations are performed to complete the fuse assembly 200.

Figure 3:
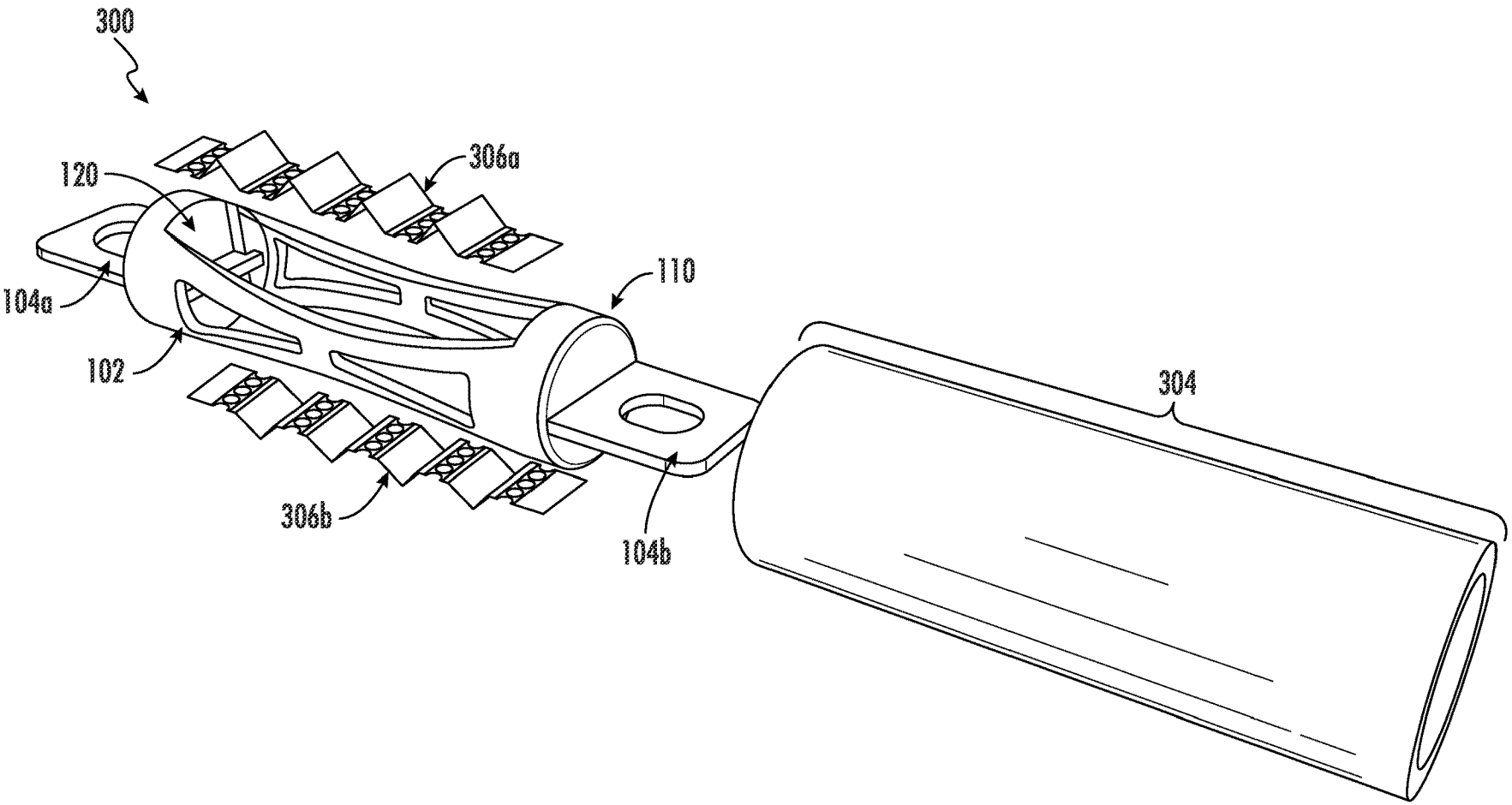
FIG. 3 is a diagram illustrating another view of a sub-structure element support system, in accordance with exemplary embodiments.

FIG. 3 is a second representative drawing of a sub-structure element support system 300, including the molded structure 102 of FIG. 1, according to exemplary embodiments. The molded structure 102 includes the integrated copper terminals 104. Two fuse elements 306*a* and 306*b* are disposed above and below the molded structure. The fuse element 306*a* is to be received into the molded structure 102 from above the molded structure through aperture 120. A second fuse element 306*b* below the molded structure 102 is to be received into the molded structure from below through a second aperture (collectively, "fuse element(s) 306"). The molded structure 102 operates as a support sleeve for receiving the fuse elements 306. Although two fuse elements 306 are shown, the molded structure 102 may receive more than two fuse elements.

Fuse elements are encased in a non-combustible enclosure to protect the fuse. The sub-structure element support system 300 features an enclosure body 304, which is cylindrical. Thus, the molded structure 102 in FIGS. 1 and 3 has a somewhat cylindrical shape. Nevertheless, the molded structure 102 may be more flattened than is shown or may be formed as a rectangular cube, a hexagonal prism, a tetrahedron, or any of a variety of other shapes to provide support to the fuse element and fit inside the non-combustible enclosure. In exemplary embodiments, the molded structure 102 is long enough to surround the fuse element 106 as shown.

In contrast to having the brass end bells 210 being affixed to a separate structure before receiving the fuse element 206 (FIG. 2), the molded structure 102 provides a self-fixtured sub-structure for receiving the fuse elements 306. Once in place within the molded structure 102, the fuse elements 306 are attached to the copper terminals 104, such as by welding or soldering. The molded structure 102 is sized so that the fuse elements 306 are automatically positioned in place between the copper terminals 104. Thus, the molded structure 102 may facilitate automating the fixturing of the fuse element to the copper terminals.

Once the fuse element(s) 306 are attached to the copper terminals 104, the enclosure body 304 is slid over the molded structure 102. The enclosure body 304 is made of glass, plastic, ceramic, melamine, or other non-conductive material, and may be transparent or opaque. Once the enclosure body is disposed over the molded structure 102 with the fuse elements 306 in place and welded/soldered to the copper terminals 104, the enclosure body is filled with sand. Finally, caps (not shown) are crimpled onto either side of the enclosure body 304, permanently encasing the fuse elements 306 within the enclosure body.

In contrast to the prior art fuse assembly 200, the sub-structure element support system 300 automatically provides support to the fuse elements 306 once the fuse element(s) are in place. This support occurs before the enclosure body 304 is slid over the molded structure 102 because the molded structure is itself a support sleeve for the fuse element(s). No temporary compression pins are needed, which eliminates another manufacturing step and saves assembly time.

In exemplary embodiments, the molded structure 102 is shaped to fit snugly inside the enclosure body 304. When the enclosure body 304 is slid over the molded structure 102 and fuse elements 306, the outer surface of the end bells 110 are snug against an inner surface of the enclosure body. Similarly, the bottom ribs 112, top ribs 114, and center portions 116 are snug against the inner surface of the enclosure body.

In this way, the molded structure 102 provides an insulating and supporting sleeve around the fuse elements.

Figure 4:
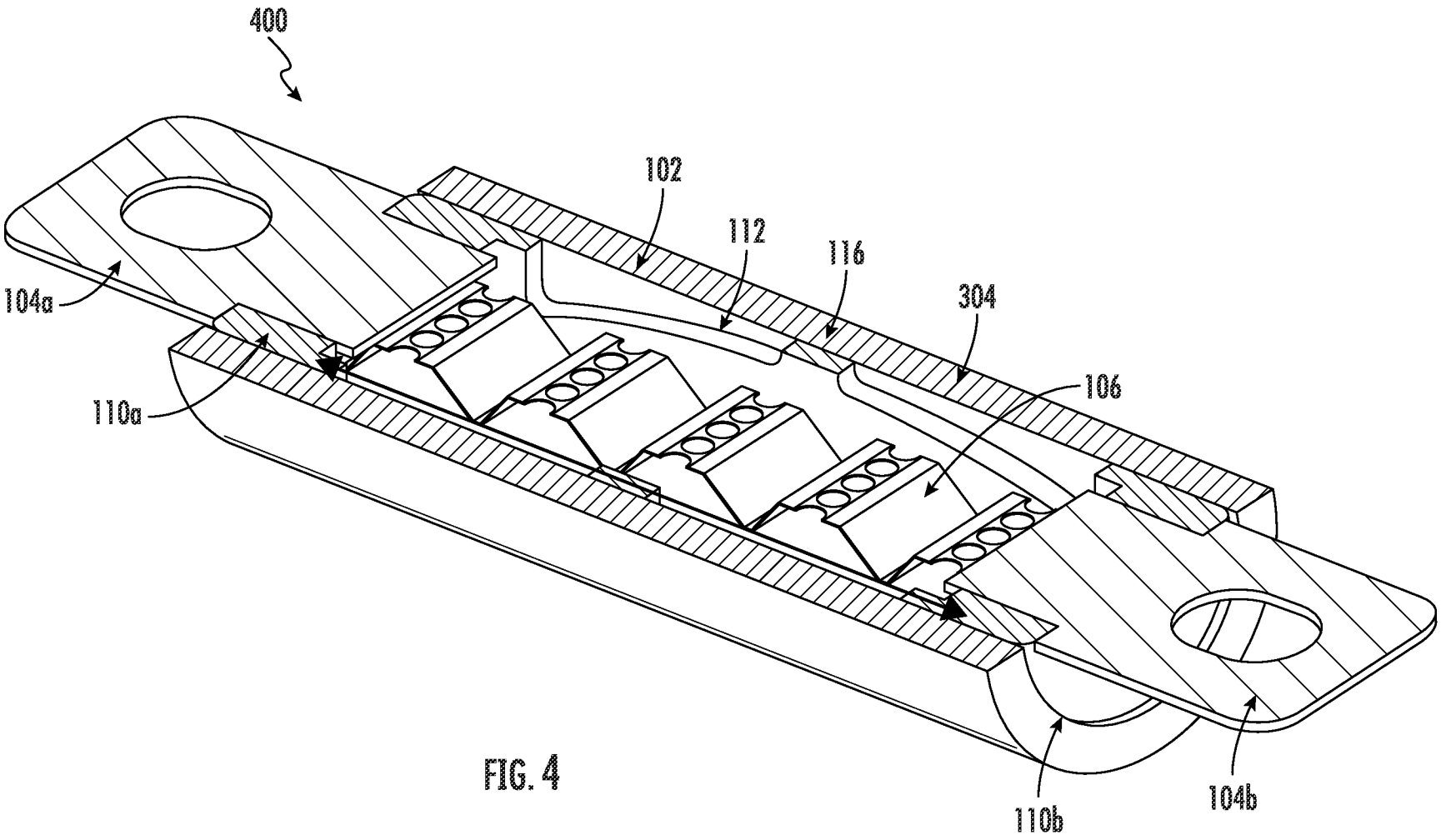
FIG. 4 is a diagram illustrating a cross-sectional view of the sub-structure element support system of FIG. 1, in accordance with exemplary embodiments.

FIG. 4 is a third representative drawing of a sub-structure element support system 400, including the molded structure 102 of FIG. 1, according to exemplary embodiments. This time, a cross-sectional view of the molded structure 102 is taken from the plane of the copper terminals 104, according to exemplary embodiments. The sub-structure element support system 400 includes the molded structure 102 of FIG. 1 with the integrated copper terminals 104. The copper terminals 104 are inserted into the slot of respective end bells 110. The fuse element 106 is disposed between the copper terminals 104 and welded or soldered thereto. The molded structure 102 is seated inside the enclosure body 304, with the cross-sectionally cut end bells 110 fitting into the inner cylindrical wall of respective ends of the enclosure body. The bottom rib 112 and the cut center portion 116 of the molded structure 102 are visible on the far side of the enclosure body 304. Once the enclosure body 304 is in place over the molded structure 102, the copper terminals 104 extend outside either end of the enclosure body.

As part of the manufacturer's quality control, fuses, like many electronic devices, generally go through some stress testing before being offered for sale. One of the tests is a free-fall test in which the fuse is dropped some distance, such as 3 feet, until the fuse falls against a steel plate. Fuse elements are, by design, fragile devices. The sacrificial portion of the fuse, for example, is designed to be destroyed once a current of a predetermined rating passes through the fuse, causing it to break, and thus protecting more expensive components of the electronic circuit. The molded structure 102 of the sub-structure element support system provides additional support to the fuse element, such as during free-fall testing.

When the free-fall test occurs, one of the copper terminals 104, the enclosure body 304 encasing the fuse elements 106, or both, will hit the steel plate. Forces of the free-fall, rather than being absorbed by the fuse element, may instead be absorbed by the ribs 112, 114, center portion 116, and end bells 110 of the molded structure 102, all of which are disposed flush against the inner wall of the enclosure body 304. The free-fall force is transmitted through the copper terminal 104 or enclosure body 304 and absorbed by the molded structure 102. The molded structure 102 thus provides sidewall support. By absorbing the forces of the fall, the molded structure 102 makes it less likely that the fuse elements 106 will be damaged.

In exemplary embodiments, the molded structure 102 also provides axial support for when the fuse is being tested in a rated voltage event. When the fuse is about to break, gases inside the fuse enclosure may push the end bells outward (toward the copper terminals). The flow of gas is an axial force, indicated in FIG. 4 by the double-sided arrow. The molded structure 102 operates as an inner skeleton of the fuse, helping to keep the end bells 110 together during the voltage event. This ensures that the fuse element 106 remains intact during the voltage event to properly protect the circuit. Because the mechanical forces are strong during a voltage event, the sub-structure element support system 400 will enable the fuse element 106 to perform its intended function. The molded structure 102 thus provides both sidewall support of the fuse element during free-fall tests and axial support for both free-fall events and forces created during rated voltage events.

Figure 5:
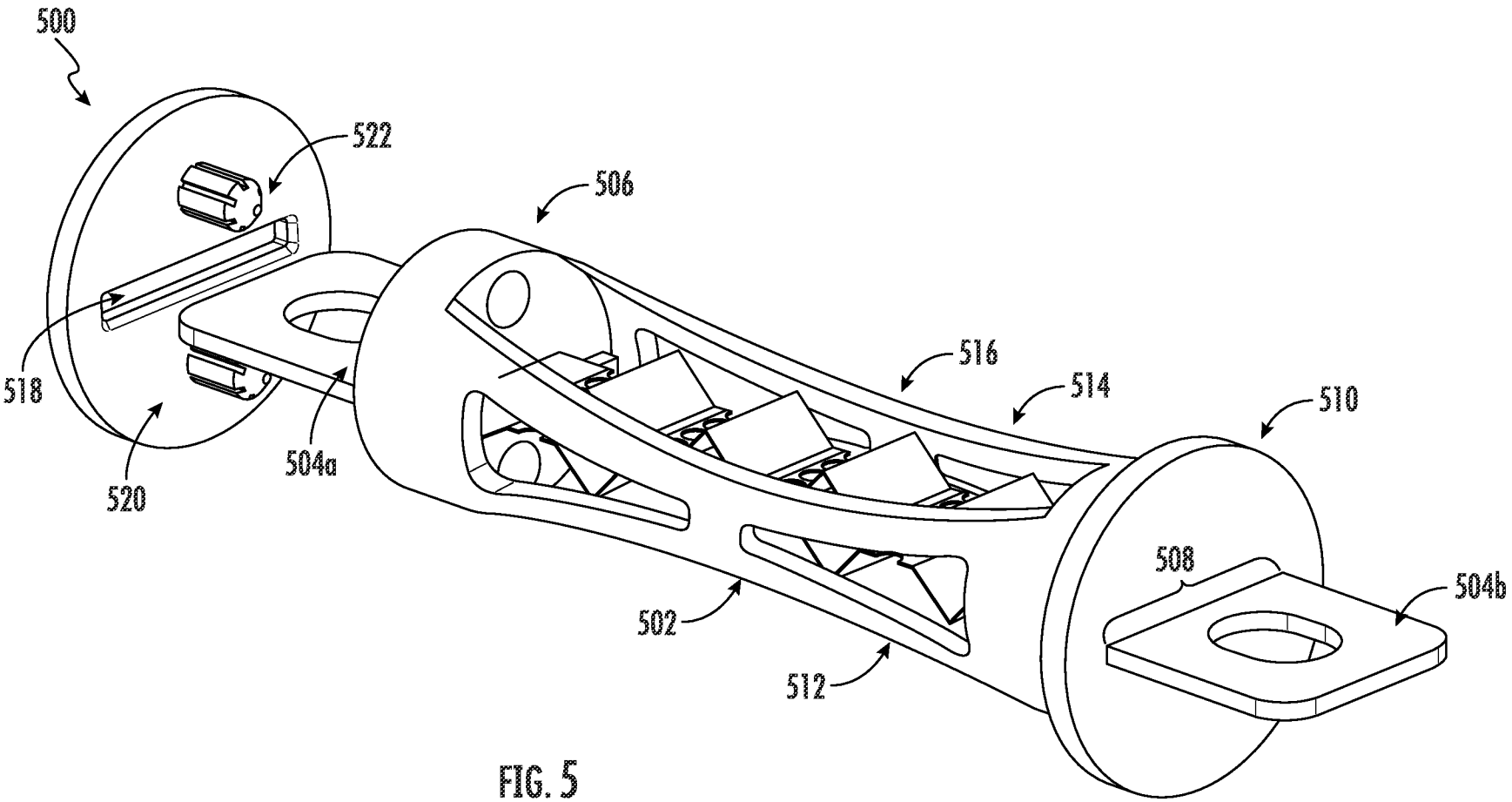
FIG. 5 is a diagram illustrating a second sub-structure element support system, in accordance with exemplary embodiments.

FIG. 5 is a representative drawing of a sub-structure element support system 500, according to exemplary embodiments. The sub-structure element support system 500 features a molded structure 502 which has one integrated end bell and one detached end bell. The molded structure 502 thus consists of two pieces, a first piece 502 that includes an end portion 506, top ribs 512, bottom ribs 514, center portion 516, and integrated end bell 510, and a second piece 520 which is the detached end bell.

The molded structure 502 includes one end bell 510, which includes a slot 508 for receiving and securing the structure through one of two copper terminals, in this case, the copper terminal 504*b* to the right. The opposing end portion 506 of the molded structure consists of a cylindrical structure with a smaller radius than the end bell 510. The top ribs 512 and bottom ribs 514 are connected between the end portion 506 and the end bell 510. The dimension of the end portion 506 is similar to the inner surface of an enclosure body (e.g., enclosure body 304 in FIGS. 3 and 4), so that the end portion fits snugly against the enclosure body inner surface, while the end bell 510 has a larger radius, and thus fits outside the enclosure body. In an exemplary embodiment, the diameter of the end bell 510 matches the outside diameter of the enclosure body.

The second piece 520, the detached end bell, is made from the same material as the rest of the molded structure 502. The detached end bell 520 also includes a slot 518 for receiving the copper terminal 504*a* (collectively, "copper terminal(s) 504").

In an exemplary embodiment, the detached end bell 520 also includes a flange 522 to be received into a receiving cavity of the left side of the molded structure 502 (not shown) for fixably attaching the molded structure 502 to the detached end bell. The flange 522 may be cylindrical for receipt into a cylindrical cavity, as illustrated, or may be another shape, with the cavity having a like receiving shape. Although a single flange is shown, the detached end bell may have multiple flanges to mate with respective receiving cavities in the molded structure 502.

In an exemplary embodiment, the slot 508 of the end bell 510 of the molded structure 502 is first received and secured through the copper terminal 504*b*, such as by molding the terminal to the structure or by press-fitting, as examples. The copper terminal 504*a* is positioned in the non-bell side of the molded structure 502. Though not visible, the inner walls of the non-bell side of the molded structure 502 includes grooves for slidably receiving the copper terminal 504*a* such that the two copper terminals are in the same plane. Where the copper terminals are press-fit into place, the slot 508 may feature grooves for receiving them. The molded structure 502 thus provides a template for receipt of the fuse element(s), with the copper terminals 504 being disposed an appropriate distance apart according to the dimensions of the fuse element. Next, the molded structure 502 receives one or more fuse elements through a top aperture, a bottom aperture, or both. The fuse elements are then fixably attached to the copper terminals through soldering or welding. One or more of these operations may be machine-automated. The molded structure 502 provides a sleeve to surround and support the fuse element(s) before the enclosure body is slid over the molded structure.

Figure 6:
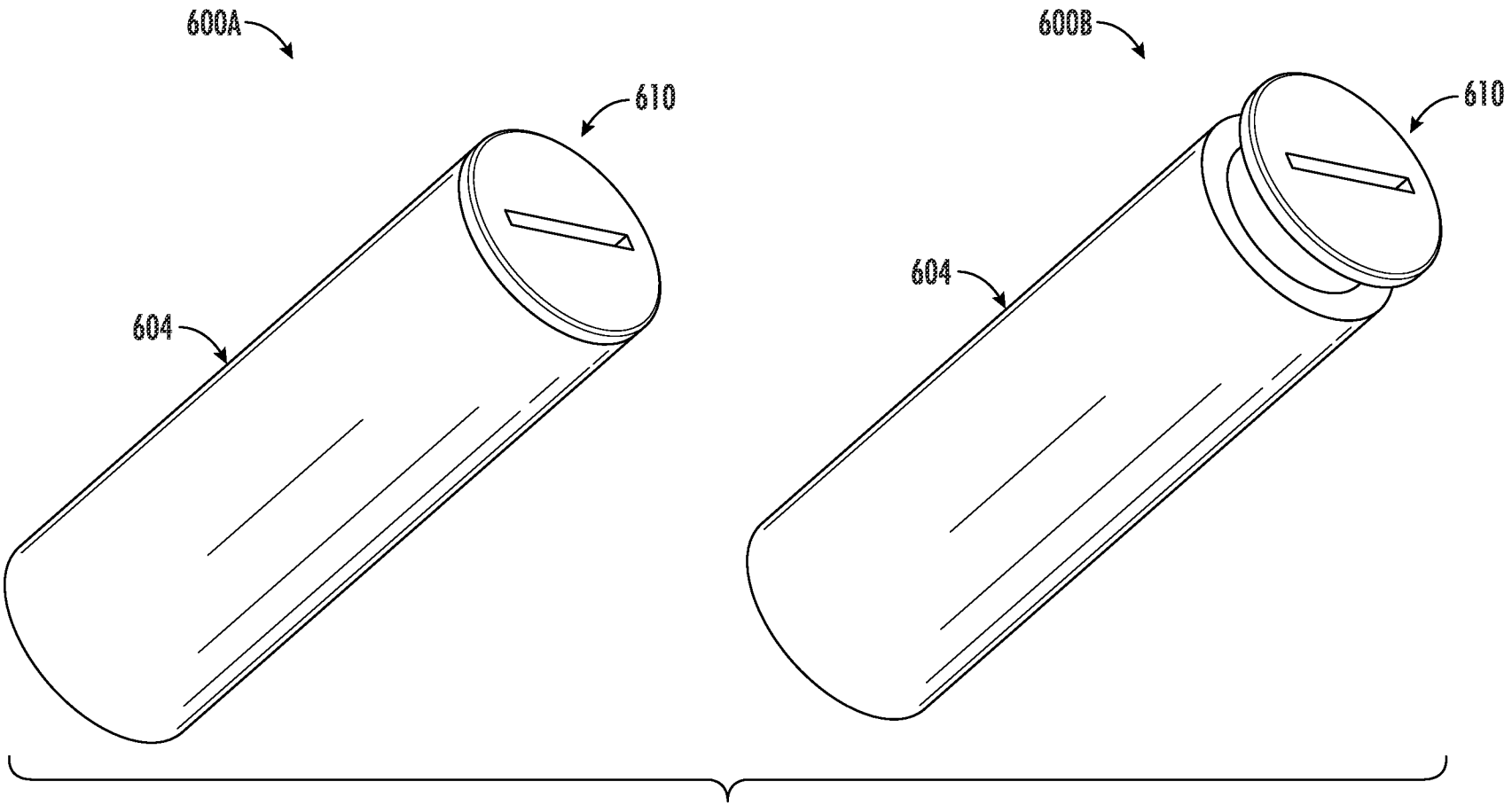
FIG. 6 are diagrams of an enclosure body with end bell secured and unsecured, in accordance with exemplary embodiments.

Whether by molding, press-fitting, or other means, once affixation to the copper terminals is complete, the enclosure body is slid over the fuse elements and molded structure 502. In one embodiment, the enclosure body may be slid over the molded structure from either direction such that the right end bell 510 is flush inside and against the enclosure body, forming a seal. In a second embodiment, the enclosure body is slid over the molded structure from left to right, such that an inner surface of the right end bell 510 is flush against the cylindrical lip of the enclosure body and the right end bell also acts as a cap or lid over the enclosure body. In the latter example, the inner surface of the right end bell 510 is circumferentially indented, such as forming a circular flange, for mating with the circular opening end of the enclosure body. FIG. 6 is an illustration of an enclosure body 604 with an end bell 610 having a circular flange, in accordance with exemplary embodiments. In the illustration 600A, the end bell 610 is securely coupled with the enclosure body 604 whereas, in the illustration 600B, the end bell not securely coupled to the enclosure body. The flange (not shown) of the end bell 610 will sit flush against the inner wall of the enclosure body 610, enabling a tight seal between the two elements.

Once the enclosure body covers the fuse element(s) and the molded structure 502, the enclosure body is filled with sand. Finally, the slot 518 of the detached end bell 520 receives and secures the left copper terminal 504*a* and the protrusion 522 is mated with its cavity of like shape and proportion so that the detached end bell is fixably mated to the molded structure 502. The detached end bell 520 is fused or fixably coupled to the molded structure 502 using glue, epoxy, ultrasonic welding, or other affixation materials or mechanisms.

Figure 7:
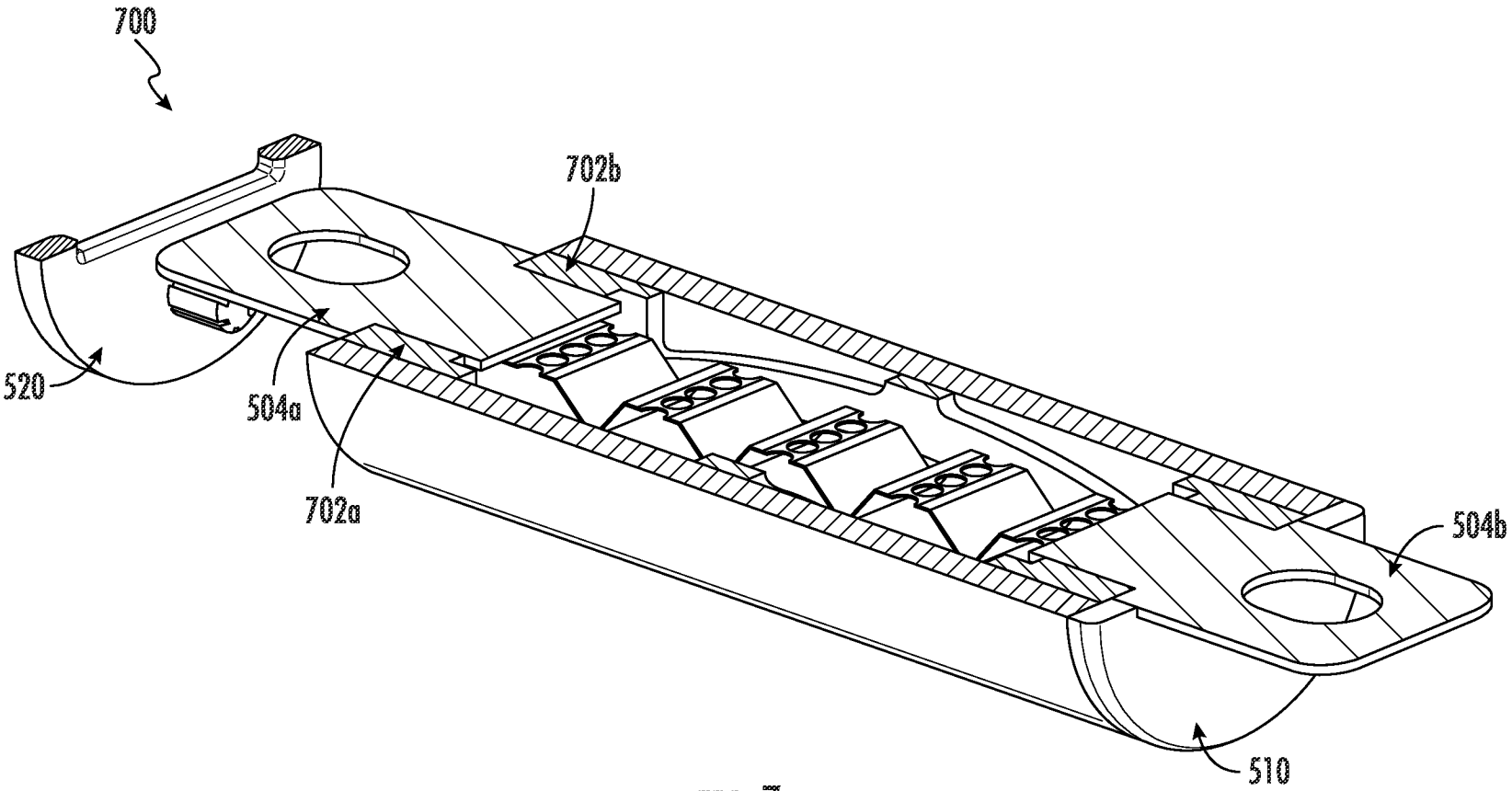
FIG. 7 is a diagram illustrating a cross-sectional view of the sub-structure element support system of FIG. 5, in accordance with exemplary embodiments.

FIG. 7 shows a cross-sectional view 700 of the molded structure 502 and detached end bell 520 of FIG. 5, according to exemplary embodiments. Although the molded structure 502 does not technically have a left end bell, the structure includes slotted receiving portions 702*a* and 702*b* to allow the left copper terminal 504*a* to be received into the molded structure before attachment of the detached end bell 520.

Although the fuse elements illustrated and described herein are industrial fuses, the principles of the sub-structure element support system illustrated and described in the various embodiments herein may be implemented with a variety of different types of fuses, including, but not limited to, automotive applications, with the molded structure being adapted to the fuse element dimensions, in accordance with the application.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A molded structure to support an electrical element, the molded structure comprising:

a first end bell coupled to a first copper terminal;

a second end bell coupled to a second copper terminal;

a plurality of ribs disposed alongside the electrical element to protect the electrical element;

a substantially cylindrical shape, wherein the molded structure fits into an enclosure body such that the end bells and the plurality of ribs rest against an inner surface of the enclosure body;

and an aperture for receiving the electrical element such that one end of the electrical element is coupled to the first copper terminal and a second end of the electrical element is coupled to the second copper terminal.

2. The molded structure of claim 1, characterized in that the first end bell comprises a first slot through which the first copper terminal is secured and the second end bell comprises a second slot through which the second copper terminal is secured, and the copper terminals are press-fit into the respective slots.

3. The molded structure of claim 1, characterized in that the first end bell is molded to the first copper terminal and the second end bell is molded to the second copper terminal.

4. The molded structure of claim 1, characterized in that the end bells and the plurality of ribs comprise a plastic, ceramic, or melamine material.

5. The molded structure of claim 3, characterized in that the plurality of ribs comprise a top rib and a bottom rib wherein the top rib and the bottom rib are coupled by a center portion.

6. The molded structure of claim 1, characterized in that the electrical element is a fuse.

7. The molded structure of claim 1, further comprising a second aperture, wherein the first aperture is disposed on a first surface of the molded structure and the second aperture is disposed on a second surface of the molded structure, wherein the first surface is on an opposite side of the second surface.

8. A sub-structure element support system comprising:

first and second copper terminals; and a molded structure comprising:

a first end bell coupled to the first copper terminal;

a second end bell coupled to the second copper terminal, wherein the first end bell is a predetermined length apart from the second end bell;

a left bottom rib, a left top rib, and a first center portion connecting the left bottom rib to the left top rib; and a right bottom rib, a right top rib, and a second center portion coupling the right bottom rib to the right top rib; and an enclosure for receiving the molded structure, wherein the first and second copper terminals are disposed on either side of the enclosure.

9. The sub-structure element support system of claim 8, the molded structure further comprising an aperture for receiving an electrical element such that one end of the electrical element is coupled to the first copper terminal and a second end of the electrical element is coupled to the second copper terminal.

10. The sub-structure element support system of claim 9, characterized in that the electrical element comprises the predetermined length.

11. The sub-structure element support system of claim 9, the molded structure further comprising a second aperture for receiving a second electrical element such that one end of the second electrical element is coupled to the first copper terminal and a second end of the second electrical element is coupled to the second copper terminal.

12. The sub-structure element support system of claim 9, wherein the one end of the electrical element is welded to the first copper terminal and the second end of the electrical element is welded to the second copper terminal.

13. A molded structure to support an electrical element, the molded structure comprising:

an end bell coupled to a first copper terminal, wherein the first copper terminal is to be welded to one end of the electrical element;

an end portion for supporting a second copper terminal, the second copper terminal to be welded to a second end of the electrical element;

bottom ribs coupled between the end bell and the end portion;

top ribs coupled between the end bell and the end portion, the bottom and top ribs to support either side of the electrical element; and a detached end bell to be affixed to the second copper terminal;

wherein the molded structure is made from a non-combustible material.

14. The molded structure of claim 13, further comprising:

an aperture for receiving the electrical element such that one end of the electrical element is coupled to the first copper terminal and a second end of the electrical element is coupled to the second copper terminal.

15. The molded structure of claim 14, further comprising:

a second aperture for receiving a second electrical element, wherein the first aperture is on one side of the molded structure and the second aperture is on an opposing side of the molded structure.

16. The molded structure of claim 13, the detached end bell further comprising a flange for fixably coupling the detached end bell to the end portion of the molded structure.

17. The molded structure of claim 13, characterized in that the non-combustible material is a plastic.

18. The molded structure of claim 13, characterized in that the non-combustible material is a ceramic.

* * * * *